US005152342A

United States Patent [19]

Rankin et al.

[11] Patent Number: 5,152,342

[45] Date of Patent: Oct. 6, 1992

[54] APPARATUS AND METHOD FOR VIBRATING A CASING STRING DURING CEMENTING

[76] Inventors: R. Edward Rankin; Kay T. Rankin, both of HCR 75, Box 10, Coleman, Tex. 76834

[21] Appl. No.: 682,615

[22] Filed: Apr. 9, 1991

Related U.S. Application Data

[63] Continuation-in-part of Ser. No. 607,893, Nov. 1, 1990.

[51] Int. Cl.[5] ..... E21B 33/14

[52] U.S. Cl. ..... 166/286; 166/177

[58] Field of Search ..... 166/286, 177, 249; 175/55, 56

[56] References Cited

U.S. PATENT DOCUMENTS

| | | | |
|---|---|---|---|
| 2,072,982 | 3/1937 | Dale | 166/286 |
| 3,335,801 | 8/1967 | Wilsey | 166/286 X |
| 4,434,944 | 3/1984 | Bodine | 166/177 X |

FOREIGN PATENT DOCUMENTS

| | | | |
|---|---|---|---|
| 897059 | 4/1972 | Canada | 166/286 |
| 791914 | 12/1980 | U.S.S.R. | 166/286 |

*Primary Examiner*—William P. Neuder
*Attorney, Agent, or Firm*—James E. Bradley

[57] ABSTRACT

A method of cementing a string of casing in a well utilizes a vibrating device downhole in the well. The vibrating device locates in the string of casing near the cement shoe. Cement slurry being pumped down the string of casing will flow through the device, out the shoe and return up the annulus. Some of the cement will flow through a bypass section of the device to power the device, causing vibrations in the casing.

16 Claims, 4 Drawing Sheets

APPARATUS AND METHOD FOR VIBRATING A CASING STRING DURING CEMENTING

CROSS REFERENCE TO RELATED APPLICATION

This application is a continuation-in-part of application Ser. No. 607,893, filed Nov. 1, 1990, "Well Conduit Vibrator", E. Edward Rankin and Kay T. Rankin.

BACKGROUND OF THE INVENTION

1. Field of the Invention

This invention relates in general to cementing casing in a well, and in particular to an apparatus and method for vibrating the casing string to facilitate the flow of cement.

2. Description of the Prior Art

When drilling an oil or gas well, sections of steel pipe, called casing, are screwed together and lowered into the well. The casing may extend to the surface. Optionally, the casing may be supported by a liner hanger at the lower end of a previously installed string of casing. In both cases, a cement shoe will be located on the lower end of the casing. The cement shoe has a float valve. Cement is pumped from the surface down the casing. The cement flows through the cement shoe and back up the annulus surrounding the casing.

It is important to have good bonding between the well formation and the casing. It is also important to have the cement flow through the annulus without leaving any voids. Sometimes to reduce the chance for voids, the operator will stroke the casing up and down several feet while the cement is being pumped down the casing. While this is workable, the casing might become stuck in an upper position. Also, sometimes an operator will rotate the casing when cementing.

SUMMARY OF THE INVENTION

In this invention, a vibrating device is secured into the string of casing near the lower end. The string of casing will be lowered into the well to the desired depth. The cement slurry being pumped through the surface flows through the vibrating device and out the lower end of the string of casing to flow back up the annulus. As it flows through the vibrating device, it powers the vibrating device to cause vibrations. These vibrations transmit along the string of casing to facilitate the flow of cement up the annulus.

The vibrating device is preferably secured in a sub mounted near the cement shoe. The vibrating device is secured in the sub by a layer of cement prior to use. The metal of the vibrating device and the supporting cement is frangible, allowing the vibrating device to be drilled up if the operator wishes to drill deeper through the casing.

DETAILED DESCRIPTION OF THE INVENTION

Figure 1:
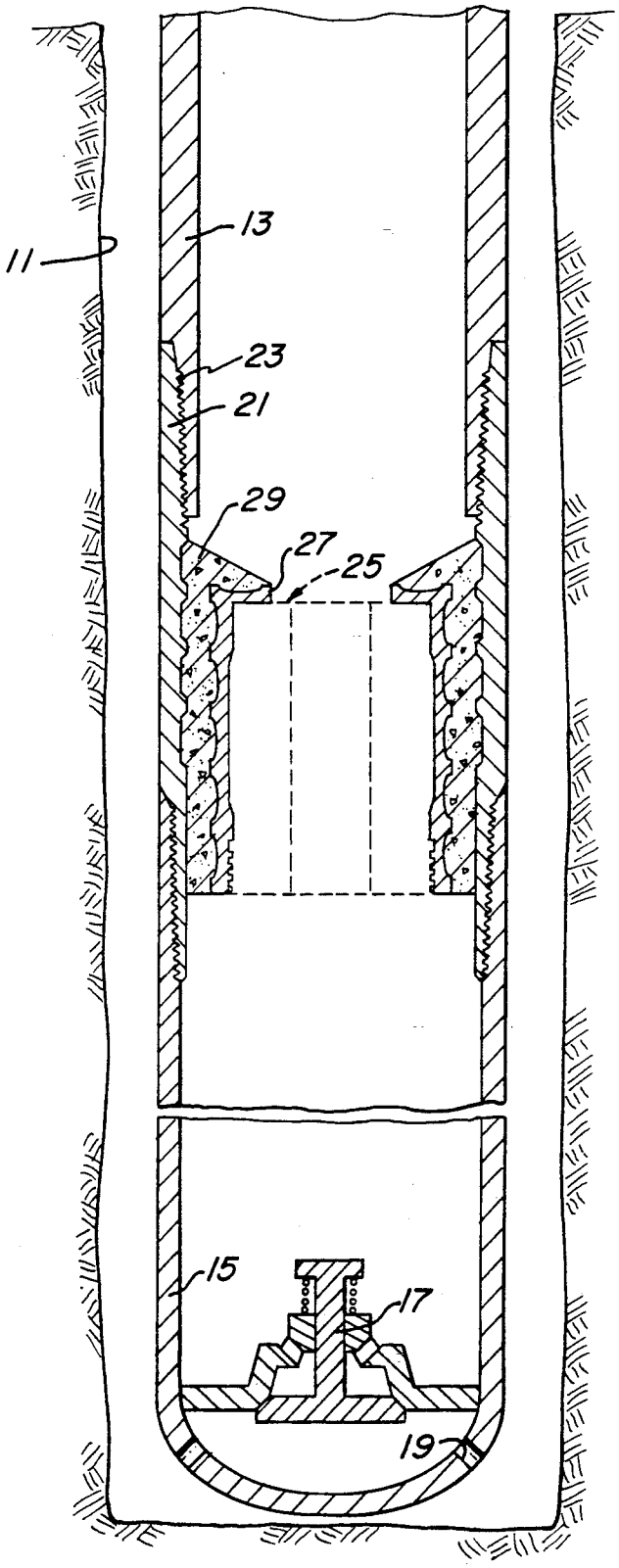
FIG. 1 is a schematic view illustrating the lower end of a string of casing having a vibrating device, shown by phantom lines, mounted above the shoe.

Referring to FIG. 1, well 11 has been previously drilled with a drill bit (not shown). A string of casing 13 is shown lowered into the well. Casing 13 is conventional, comprised of sections of pipe screwed together. A conventional cement shoe 15 will be located on the bottom. Cement shoe 15 may be of various types. The one illustrated shows schematically a check valve 17 which allows cement slurry to flow through and out holes 19 in the bottom of cement shoe 15. Check valve 17 prevents back flow of the cement from the annulus surrounding casing 13 back up into the interior of casing 13.

A sub 21 is shown connected into the string of casing 13 directly above the cement shoe 15. Sub 21 preferably is located no more than one section of casing 13 above cement shoe 15. Sub 21 has threads 23 on its upper and lower ends for connecting the cement shoe 15 to casing 13.

A vibrating device 25 locates inside sub 21. Vibrating device 25 has a cylindrical housing 27. Housing 27 is secured in the sub 21 by a layer of hardened cement 29. The vibrating device 25 and cement 29 are frangible so that subsequently they will disintegrate when drilled by a drill bit if further drilling is desired. Constructing cement shoes components of frangible metal and supporting them with a liner of cement is a prior art technique. The same types of metal and cement 29, in general, may be utilized with vibrating device 25.

The cement slurry being pumped down the string of casing 13 will pass through a main flow passage 31 in vibrating device 25. As the cement slurry flows through the vibrating device 25, some of the cement will be diverted into a bypass passage to power the vibrating device 25. This bypass flow of cement slurry causes vibrating device 25 to vibrate to enhance the flow of cement back up the annulus surrounding casing 13.

Figure 2:
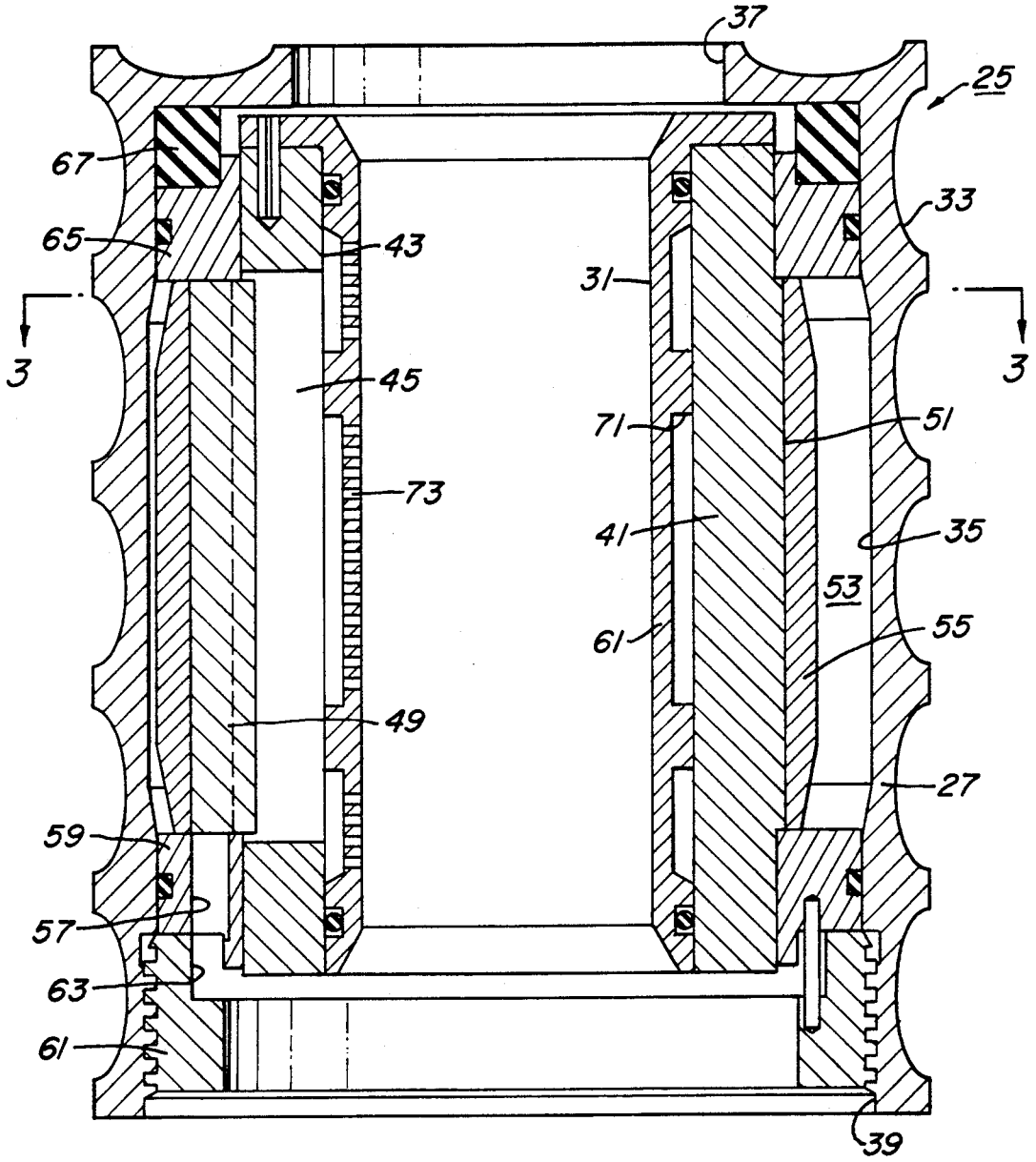
FIG. 2 is an enlarged vertical sectional view illustrating the vibrating device of FIG. 1, and shown removed from the sub.

Referring to FIG. 2, the housing 27 has circumferential grooves 33 on its exterior. Grooves 33 enhance the bonding of the hardened cement layer 29 to the inner wall of the sub 21 (FIG. 1). Housing 27 has an inner wall surface 35 that is generally cylindrical. An inlet 37 locates at the top of housing 27. An outlet 39 locates at the bottom of housing 27.

An inner cylinder 41 is stationarily mounted inside the housing 35. The outer diameter of inner cylinder 41 is less than the inner diameter of the inner wall surface 35. The inner cylinder 41 has a cylindrical bore 43 extending axially through it. A longitudinal slot 45 locates on one side. Slot 45 is axial. It does not extend the full length of inner cylinder 41, rather terminates above the lower end and below the upper end.

Figure 5:
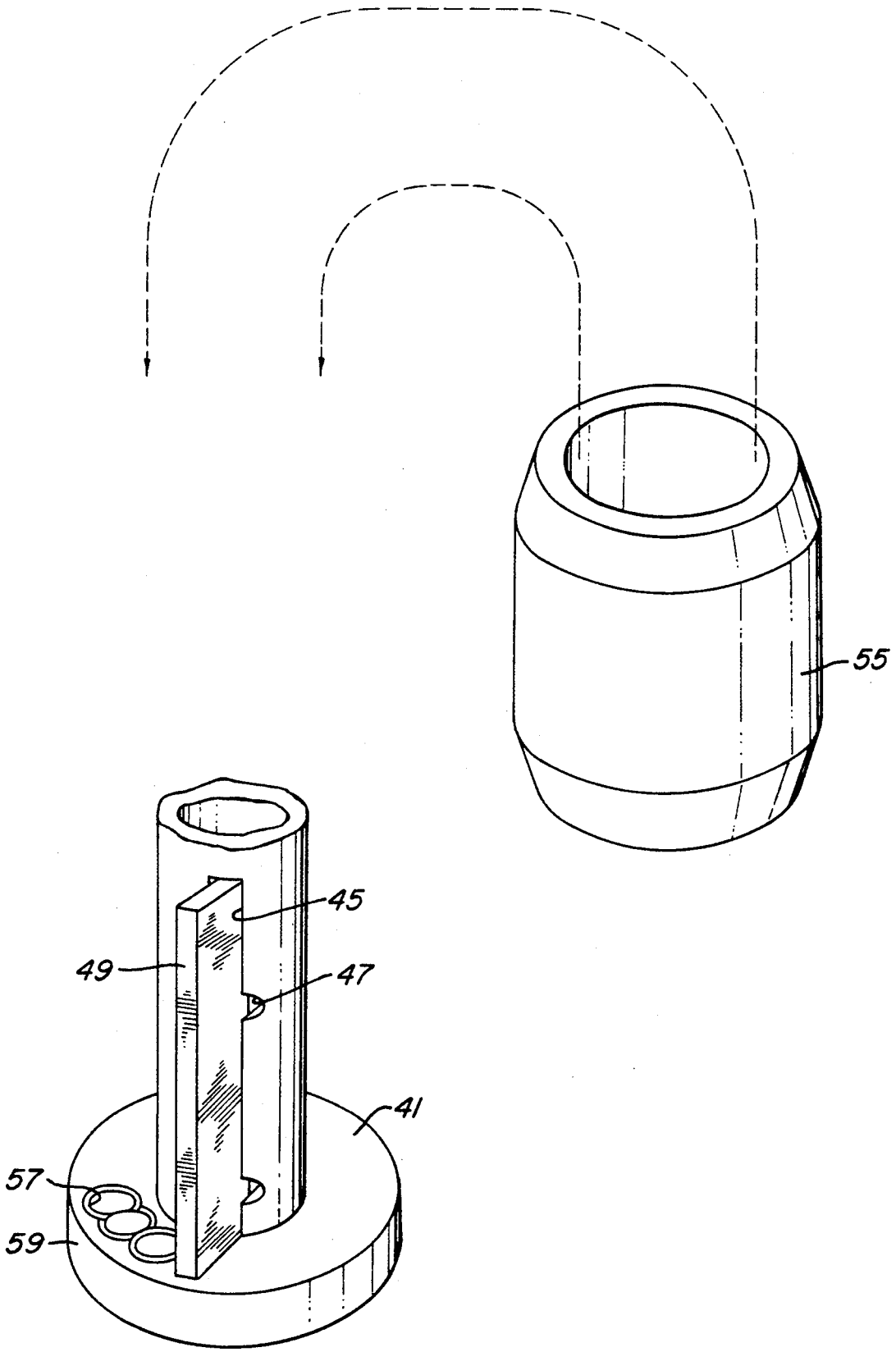
FIG. 5 is a perspective view of portions of the vibrator of FIG. 2.

Referring to FIG. 5, a plurality of slot ports 47 are formed on one side of the slot 45. The slot ports 47 are spaced apart from each other axially. Ports 47 are shown on the right side of slot 45, with the opposite side (not shown) of slot 45 being straight.

Figure 3:
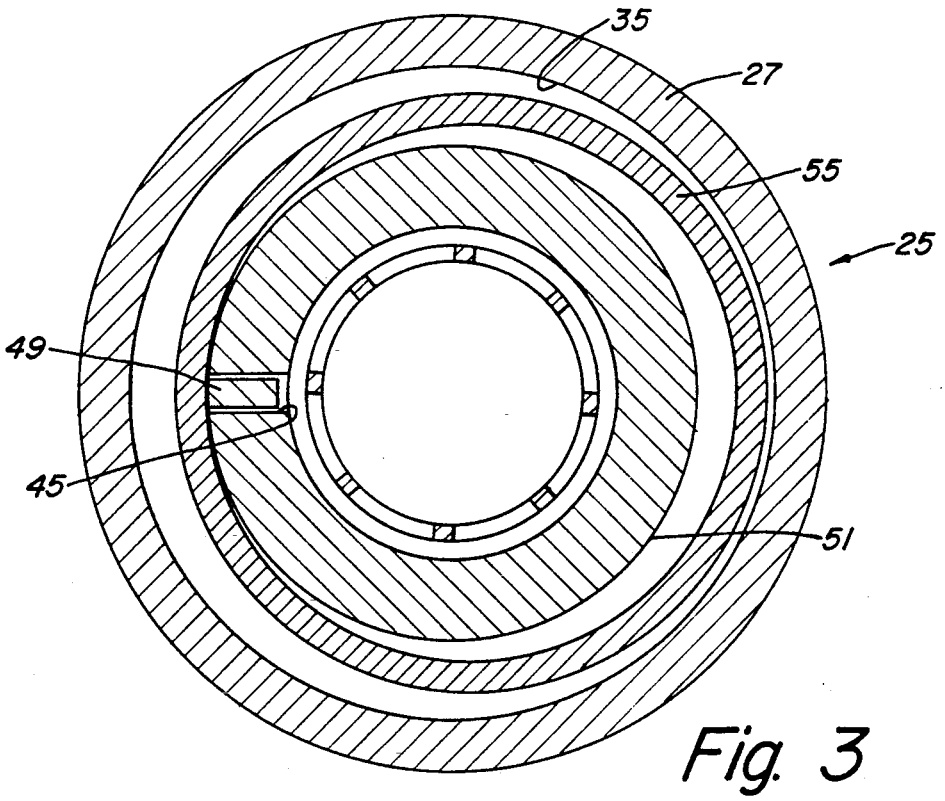
FIG. 3 is a sectional view of the vibrating device of FIG. 2, taken along the line II—II of FIG. 2.

A vane 49 is carried moveably in the slot 45. Vane 49 is a rectangular metal strip of approximately the same length as slot 45. The width of vane 49 is only slightly less than the width of slot 45. As can be seen by comparing FIGS. 3 and 4, vane 49 will move on a radial line of the longitudinal axis of housing 27. It will move from a radial inner position, as shown in FIG. 3, to an outer position shown in FIG. 4.

Inner cylinder 41 has an outer wall surface 51 that is cylindrical and is of lesser diameter than the inner wall surface 35 of housing 27. This results in an annular clearance 53. A drum 55 is carried in the annular clearance. Drum 55 is a cylindrical metal ring that will move eccentrically within the annular clearance 53. In the position shown in FIG. 4, drum 55 has its axis located to the left of the axis of housing 27. In FIG. 5, drum 55 has its axis located to the right of the axis of housing 27.

Figure 4:
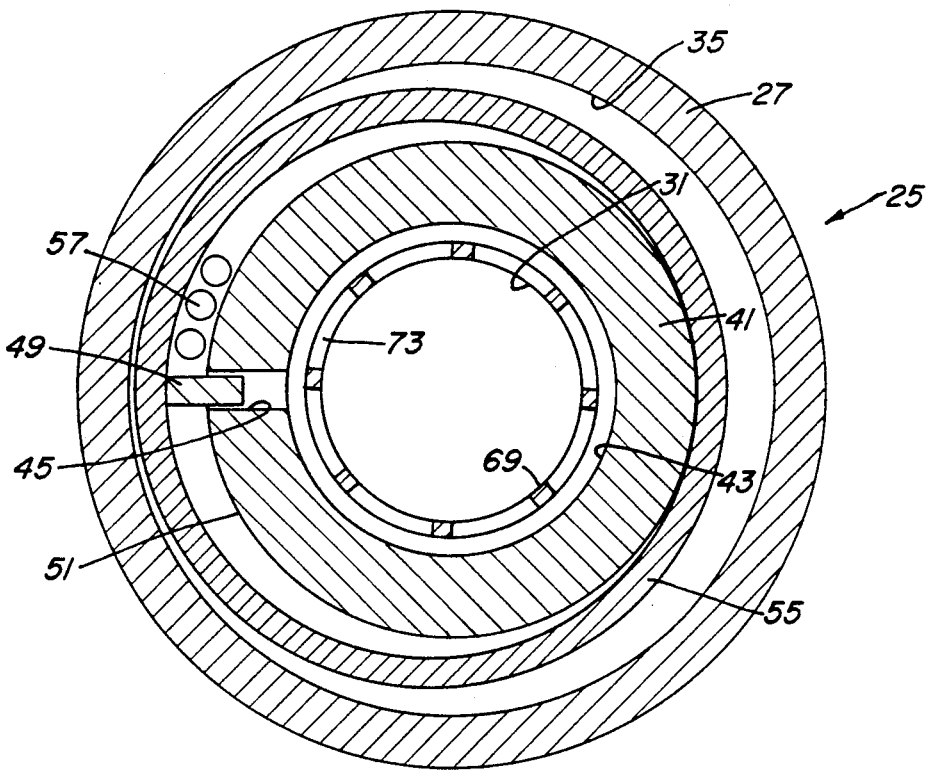
FIG. 4 is a sectional view like FIG. 3, but showing the drum of the vibrator in another position.

Drum 55 is pushed between the left and right positions by means of the vane 49. Drum 55 will also rotate during its eccentric movement. In FIG. 3, the drum 55 is contacting one side of the inner wall surface 35 of housing 27. In FIG. 4, the drum 55 is contacting the opposite side of the housing inner wall surface 35. The contact of the drum 55 with the housing inner wall surface 35 causes vibration.

The eccentric movement is caused by movement of vane 49 in cooperation with outlet ports 57, shown in FIGS. 2 and 4. Outlet ports 57 extend vertically through a flange 59. Flange 59 is located below and supports the inner cylinder 41. Drum 55 also rests on flange 59.

Referring to FIG. 3, the fluid flowing out the slot ports 47 (FIG. 5) will push the drum 55 to the left. The fluid is unable to flow directly to the outlet ports 57 because the ports 57 will be blocked by the drum 55. The fluid must flow counterclockwise around the inner cylinder 41. In doing this, drum 55 will move to the left to the position shown in FIG. 4. This movement exposes the ports 57 to allow the fluid to flow out the ports 57. The continual flow of fluid out the slot ports 47 (FIG. 5) then pushes the drum 55 back to the position shown in FIG. 5. The oscillation depends on the rate of the fluid flow through the housing 27.

Referring again to FIG. 2, the flange 59 is supported by a retainer ring 61. Retainer ring 61 secures by threads into the outlet 39. Retainer ring 61 has a recess 63 on its upper edge to provide a flow passage for the fluid out the outlet ports 57 and out the outlet 39. An upper retainer 65 supports the inner cylinder 41 on its upper end. Upper retainer 65 bears against an elastomeric spacer ring 67.

A filter 69 locates in the bore 43 of inner cylinder 41. Filter 69 filters the cement slurry flowing through the slot ports 47. Filter 69 is a cylindrical member, with its inner diameter serving as the main flow passage for the flow of cement. It has circumferential bands 71 that space the cylindrical wall of filter 69 from the bore 43 of inner cylinder 41. The cylindrical wall of filter 69 has a plurality of slots 73. Slots 73 allow the flow of some of the cement slurry through the slot ports 47, but filter larger cement particles.

In operation, the vibrating device 25 will be mounted within sub 21 by pouring a layer of cement 29 between the outer wall of housing 27 and the inner wall of sub 21. The layer 29 will be allowed to harden.

When the casing 13 is to be run, the sub 21 will be mounted in the string of casing 13 directly above the cement shoe 15. Once the casing 13 reaches bottom, then the operator will begin pumping the cement slurry down casing 13. The cement slurry will flow through the main flow passage 31, and out the holes 19 to return back up the annulus.

Some of the cement slurry will flow through the bypass passage to power the vibrating device 25. The bypass passage consists of the slot ports 47, the annular clearance 53, and the outlet ports 57. As the slurry flows through the slot ports 47, the drum 55 will oscillate back and forth. The striking of the side wall of drum 55 on the housing 27 creates a vibration that transmits through the sub 21 and through the casing 13. This vibration facilitates the flow of cement back up the annulus. The vibration reduces the tendency for voids in the cement to occur.

When the desired amount of cement has been pumped down casing 13, a plug will be pumped down casing 13. The plug will contact and be stopped by the upper side of the vibrating device 25. If the operator wishes to drill through casing 13 to drill the well 11 to a greater depth, a drill bit will be lowered on drill pipe to disintegrate the plug, cement layer 29, vibrating device 25, and internal portions of the cement shoe 15.

The invention has significant advantages. It enhances the flow of cement to reduce voids and increase bonding. It is simple in structure and expendable. It may in some cases remove the need to stroke or rotate the pipe during cementing.

While the invention has been shown in only one of its forms, it should be apparent to those skilled in the art that it is not so limited, but is susceptible to various changes without departing from the scope of the invention.

We claim:

1. A method of cementing a string of casing in a well, comprising:

securing a vibrating device into the string of casing near the lower end of the string of casing;

lowering the string of casing into the well to the desired depth;

pumping a cement slurry down the string of casing, through the vibrating device and out the lower end of the string of casing to flow back up the annulus surrounding the string of casing;

causing a portion of the cement slurry being pumped down the string of casing to vibrate the vibrating device, thereby vibrating a portion of the string of casing to enhance the flow of the cement; and wherein the vibrating device is secured in the string of casing by cementing the vibrating device within a sub, then securing the sub into the string of casing prior to lowering the string of casing into the well.

2. A method of cementing a string of casing in a well, comprising:

securing a vibrating device into the string of casing near the lower end of the string of casing;

lowering the string of casing into the well to the desired depth;

pumping a cement slurry down the string of casing, through the vibrating device and out the lower end of the string of casing to flow back up the annulus surrounding the string of casing;

causing a portion of the cement slurry being pumped down the string of casing to vibrate the vibrating device, thereby vibrating a portion of the string of casing to enhance the flow of the cement; and further comprising:

mounting a filter to the vibrating device; and filtering the portion of the cement slurry that causes vibration of the vibrating device.

3. A method of cementing a string of casing in a well, comprising:

securing a vibrating device into the string of casing near the lower end of the string of casing;

lowering the string of casing into the well to the desired depth;

pumping a cement slurry down the string of casing, through the vibrating device and out the lower end of the string of casing to flow back up the annulus surrounding the string of casing;

causing a portion of the cement slurry being pumped down the string of casing to vibrate the vibrating device, thereby vibrating a portion of the string of casing to enhance the flow of the cement; and further comprising:

providing the vibrating device with an axial main flow passage and a bypass passage adjacent the main flow passage; and pumping the portion of the cement slurry that causes vibration of the vibrating device through the bypass passage, and pumping the remaining portion of the cement slurry through the main flow passage.

4. A method of cementing a string of casing in a well, comprising:

providing a vibrating device with a main flow passage and a bypass flow passage;

providing the vibrating device with a vibrating element which vibrates in response to flow through the bypass flow passage;

securing the vibrating device into the string of casing near the lower end of the string of casing;

lowering the string of casing into the well to the desired depth; then pumping a cement slurry down the string of casing, through the main flow passage of the vibrating device and out the lower end of the string of casing to flow back up the annulus surrounding the string of casing, with a portion of the cement slurry flowing through the bypass passage to vibrate the vibrating element to enhance flowing of the cement slurry.

5. The method according to claim 4, further comprising:

lowering a drill bit on a string of drill pipe into the casing after the cement has set;

rotating the drill bit to drill out the vibrating device; then continuing to rotate the drill bit to drill the well deeper below the lower end of the string of casing.

6. The method according to claim 4 wherein the string of casing includes a cementing shoe of its lower end, and wherein the vibrating device is secured in the string of casing directly above the lower end of the cementing shoe.

7. The method according to claim 4 wherein the vibrating device is secured in the string of casing by cementing the vibrating device within a sub, then securing the sub into the string of casing prior to lowering the string of casing into the well.

8. The method according to claim 4 further comprising:

mounting a filter to the vibrating device; and filtering the portion of the cement slurry that flows through the bypass passage.

9. A method of cementing a string of casing in a well, comprising:

providing a vibrating device with the following:

a tubular housing;

an inner cylinder mounted in the housing, defining an annular clearance between the inner cylinder and the outer housing;

a drum carried in the housing in the clearance between the inner cylinder and the housing for eccentric movement relative to the axis of the housing; and port means for causing a portion of fluid pumped into the inner cylinder to oscillate the drum eccentrically;

securing the vibrating device into the string of casing near the lower end of the string of casing;

lowering the string of casing into the well to the desired depth; then pumping a cement slurry down the string of casing, through the inner cylinder of the vibrating device and out the lower end of the string of casing to flow back up the annulus surrounding the string of casing, with a portion of the cement slurry flowing through the port means to oscillate the drum to enhance flowing of the cement slurry; and wherein the vibrating device is secured in the string of casing by cementing the vibrating device within a sub, then securing the sub into the string of casing prior to lowering the string of casing into the well.

10. A method of cementing a string of casing in a well, comprising:

providing a vibrating device with the following:

a tubular housing;

an inner cylinder mounted in the housing, defining an annular clearance between the inner cylinder and the outer housing;

a drum carried in the housing in the clearance between the inner cylinder and the housing for eccentric movement relative to the axis of the housing; and port means for causing a portion of fluid pumped into the inner cylinder to oscillate the drum eccentrically;

securing the vibrating device into the string of casing near the lower end of the string of casing;

lowering the string of casing into the well to the desired depth; then pumping a cement slurry down the string of casing, through the inner cylinder of the vibrating device and out the lower end of the string of casing to flow back up the annulus surrounding the string of casing, with a portion of the cement slurry flowing through the port means to oscillate the drum to enhance flowing of the cement slurry; and further comprising:

mounting a filter to the vibrating device; and filtering the portion of the cement slurry that flows through the port means.

11. In an apparatus for cementing a well having sections of casing secured together to define a string of casing for cementing within a well, an improved device for improving the flow of cement slurry through the string of casing, comprising in combination:

a vibrating device mounted near the lower end of the string of casing, the vibrating device having a main flow passage and a bypass flow passage; and a vibrating element carried in the vibrating device which vibrates in response to fluid flow through the bypass flow passage, so that cement slurry being pumped down the string of casing flows through the main flow passage and also through the bypass flow passage, causing the vibrating element to vibrate to enhance the flow of the cement slurry; and further comprising filter means for filtering the flow of cement slurry through the bypass passage.

12. In an apparatus for cementing a well having sections of casing secured together to define a string of casing for cementing within a well, an improved device for improving the flow of cement slurry through the string of casing, comprising in combination:

a vibrating device mounted near the lower end of the string of casing, the vibrating device having a main flow passage and a bypass flow passage; and a vibrating element carried in the vibrating device which vibrates in response to fluid flow through the bypass flow passage, so that cement slurry being pumped down the string of casing flows through the main flow passage and also through the bypass flow passage, causing the vibrating element to vibrate to enhance the flow of the cement slurry; and further comprising:

a sub having connection means for connection into the string of casing; and the vibrating device being cemented within the sub prior to connection of the sub into the string of casing.

13. An improved device for improving the flow of cement slurry through a string of casing located within a well, comprising in combination:

a tubular housing;

mounting means for mounting the housing into the string of casing;

an inner cylinder mounted in the housing, defining an annular clearance between the inner cylinder and the outer housing, the inner cylinder having an axial main flow passage therethrough for the passage of cement slurry being pumped down the string of casing;

a drum carried in the housing in the clearance between the inner cylinder and the housing for eccentric movement relative to the axis of the housing; and port means including a port in the inner cylinder for causing a portion of cement slurry pumped into the inner cylinder to flow into the clearance and to oscillate the drum eccentrically.

14. The device according to claim 13 wherein the mounting means comprises:

a sub having an axial bore with a bore wall;

a frangible layer between the exterior of the housing and the bore wall, bonding the housing to the bore wall; and connection means on the sub for connecting the sub into the string of casing.

15. The device according to claim 13 further comprising filter means mounted in the inner cylinder for filtering the cement slurry flowing through the port means.

16. In an apparatus for cementing a well having sections of casing secured together to define a string of casing for cementing within a well, an improved device for improving the flow of cement slurry through the string of casing, comprising in combination:

a sub having an axial bore with a bore wall;

a tubular housing located in the bore of the sub;

a frangible layer between the exterior of the housing and the bore wall, bonding the housing to the bore wall;

connection means on the sub for connecting the sub into the string of casing;

an inner cylinder mounted in the housing, defining an annular clearance between the inner cylinder and the outer housing, the inner cylinder having an axial main flow passage therethrough for the passage of cement slurry being pumped down the string of casing;

a drum carried in the housing in the clearance between the inner cylinder and the housing for eccentric movement relative to the axis of the housing; and port means including a port in the inner cylinder for causing a portion of cement slurry pumped into the inner cylinder to flow into the clearance and to oscillate the drum eccentrically; and an annular filter mounted in the main flow passage of the inner cylinder for filtering the cement slurry flowing through the port means.

* * * * *